US006216864B1

(12) United States Patent
Chang

(10) Patent No.: US 6,216,864 B1
(45) Date of Patent: Apr. 17, 2001

(54) INDIVIDUAL GOLD CLUB HOLDER FOR GOLF BAG

(76) Inventor: Chin-Lan Chang, 4th Fl., 101-1, Chi Lin Road, Yang Chou Tsun, Lu Chu, Taoyuan Hsien (TW)

( * ) Notice: Subject to any disclaimer, the term of this patent is extended or adjusted under 35 U.S.C. 154(b) by 0 days.

(21) Appl. No.: 09/589,760

(22) Filed: Jun. 9, 2000

(51) Int. Cl.[7] ..... A63B 57/00
(52) U.S. Cl. ..... 206/315.2; 206/315.6
(58) Field of Search ..... 206/315.2, 315.3, 206/315.6; 211/70.2

(56) References Cited

U.S. PATENT DOCUMENTS 3,931,842 * 1/1976 White ..... 206/315.6 X
4,194,847 * 3/1980 Sidor et al. ..... 206/315.6
5,088,600 * 2/1992 Kopp, Jr. ..... 206/315.2
5,275,278 * 1/1994 Henry et al. ..... 206/315.2 X
5,720,388 * 2/1998 King et al. ..... 206/315.2
5,816,396 * 10/1998 Shin ..... 206/315.2 X
5,834,738 * 11/1998 Wilson ..... 206/315.3 X

FOREIGN PATENT DOCUMENTS

2234912 * 2/1991 (GB) ..... 206/315.3

* cited by examiner

*Primary Examiner*—Sue A. Weaver
(74) *Attorney, Agent, or Firm*—Dougherty & Troxell

(57) ABSTRACT

An individual golf club holder installed in a golf bag to hold an individual golf club, including a tubular body, the tubular body having multiple sets of vertically spaced through holes spaced around the periphery of a bottom end thereof, a top cap and a bottom cap covered on top and bottom ends of the tubular body, the top cap having a center hole through which a golf club is inserted into the tubular body, and a plurality of golf club retainers respectively installed in the through holes on the tubular body, the golf club retainers each having a plurality of flexible retaining rods suspended in the tubular body for engagement with the periphery of the golf club inserted into the tubular body.

6 Claims, 8 Drawing Sheets

INDIVIDUAL GOLD CLUB HOLDER FOR GOLF BAG

BACKGROUND OF THE INVENTION

The present invention relates to golf bags, and more specifically to an individual golf club holder for installation in a golf bag to hold a golf club in the golf bag.

A golf bag may be equipped with a partition block in the top cuff for keeping storage golf clubs in good order. The partition block has through holes through which golf clubs are respectively inserted into the inside of the golf bag. However, the partition block cannot stop the grips of the storage golf clubs from touching one another.

SUMMARY OF THE INVENTION

The present invention provides individual golf club holders for installation in a golf bag to hold golf clubs in the golf bag individually. According to the present invention, the a tubular body, the tubular body having multiple sets of vertically spaced through holes spaced around the periphery of a bottom end thereof, a top cap and a bottom cap covered on top and bottom ends of the tubular body, the top cap having a center hole through which a golf club is inserted into the tubular body, and a plurality of golf club retainers respectively installed in the through holes on the tubular body for engagement with the periphery of the golf club inserted into the tubular body. In one embodiment of the present invention, the golf club retainers each have a plurality of flexible retaining rods suspended in the tubular body for engagement with the golf club inserted into the tubular body. In another embodiment of the present invention, the golf club retainers each have a plurality of plastic brushes suspended in the tubular body for engagement with the golf club inserted into the tubular body.

DETAILED DESCRIPTION OF THE PREFERRED EMBODIMENT

Figure 13:
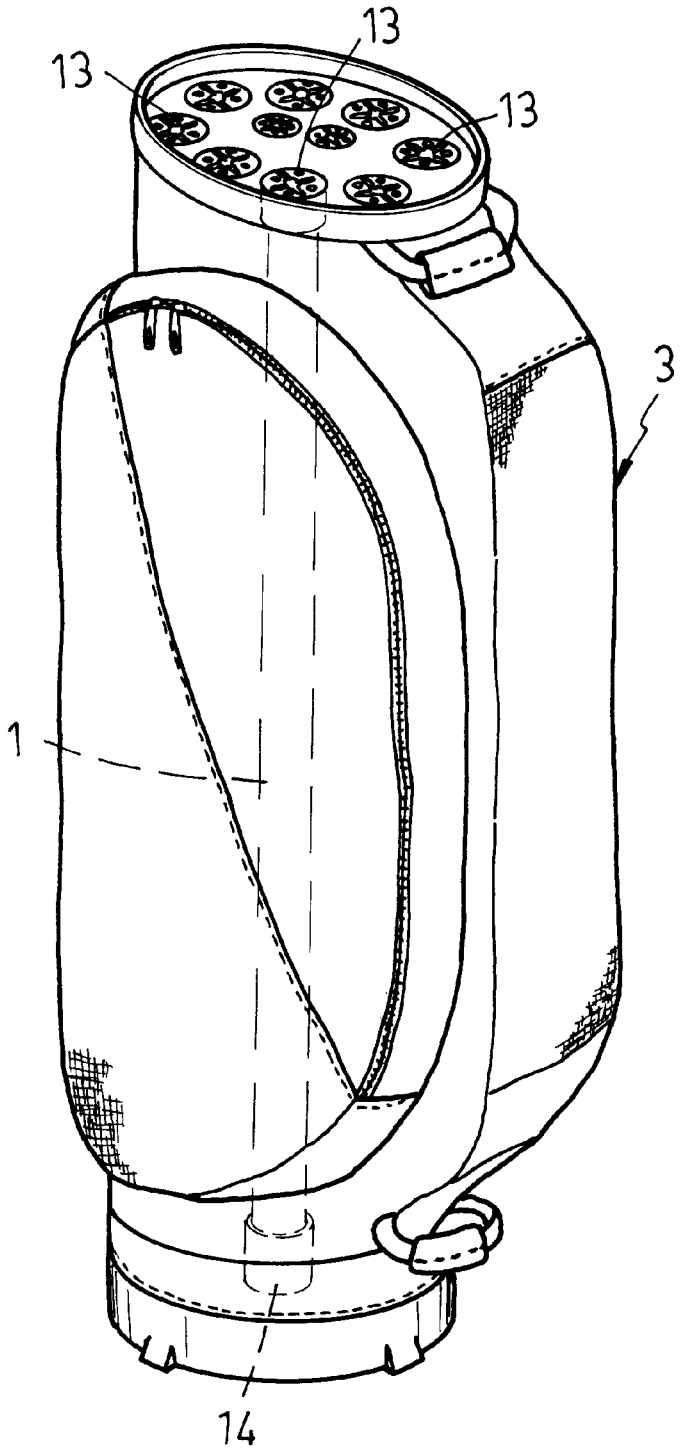
FIG. 13 is an applied view of the present invention, showing individual golf club holders installed in a golf bag.

Referring to FIGS. from 1 through 4 and FIG. 13, an individual golf club holder is installed in a golf bag 3 to hold a golf club, comprising a tubular body 1, a top cap 13, and a bottom cap 14. The top cap 13 and the bottom cap 14 are respectively covered on top and bottom ends of the tubular body 1. The top cap 13 has a circular center hole through which a golf club is inserted into the tubular body 1. The tubular body 1 has longitudinal rows of through holes 11 spaced around the periphery near the bottom end thereof. A plurality of golf club retainers 12 are installed in the longitudinal rows of through holes 11 for engagement with the golf club inserted into the tubular body 1. Each golf club retainer 12 comprises a connecting rod 122 disposed outside the tubular body 1, and a plurality of retaining elements 121 respectively perpendicularly extended from the connecting rod 122 and respectively inserted through one longitudinal row of through holes 11 into the inside of the tubular body 1.

Figure 1:
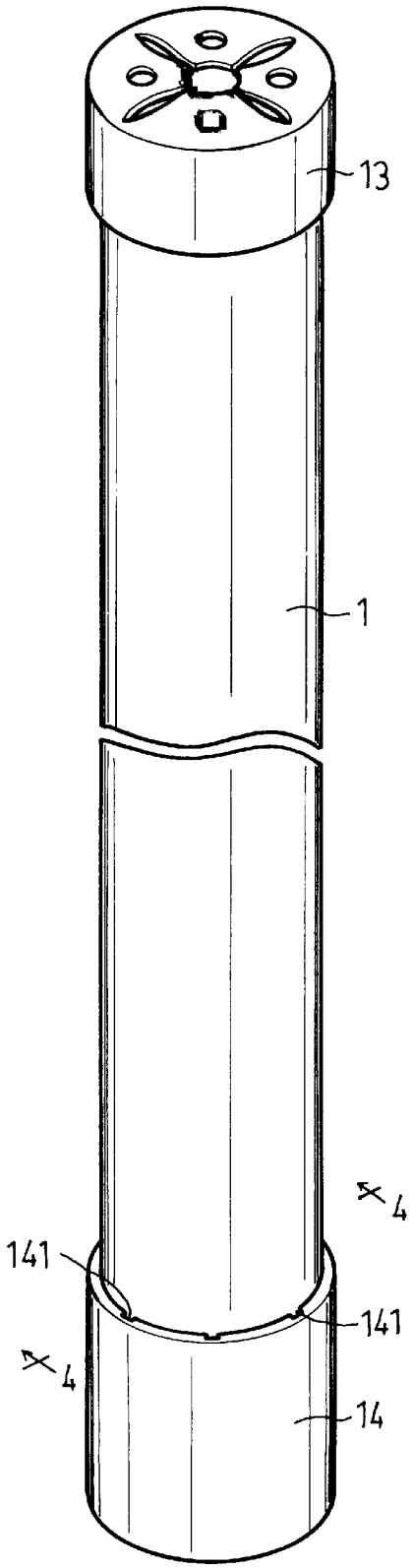
FIG. 1 illustrates the outer appearance of an individual golf club holder for golf bag according to one embodiment of the present invention.
Figure 2:
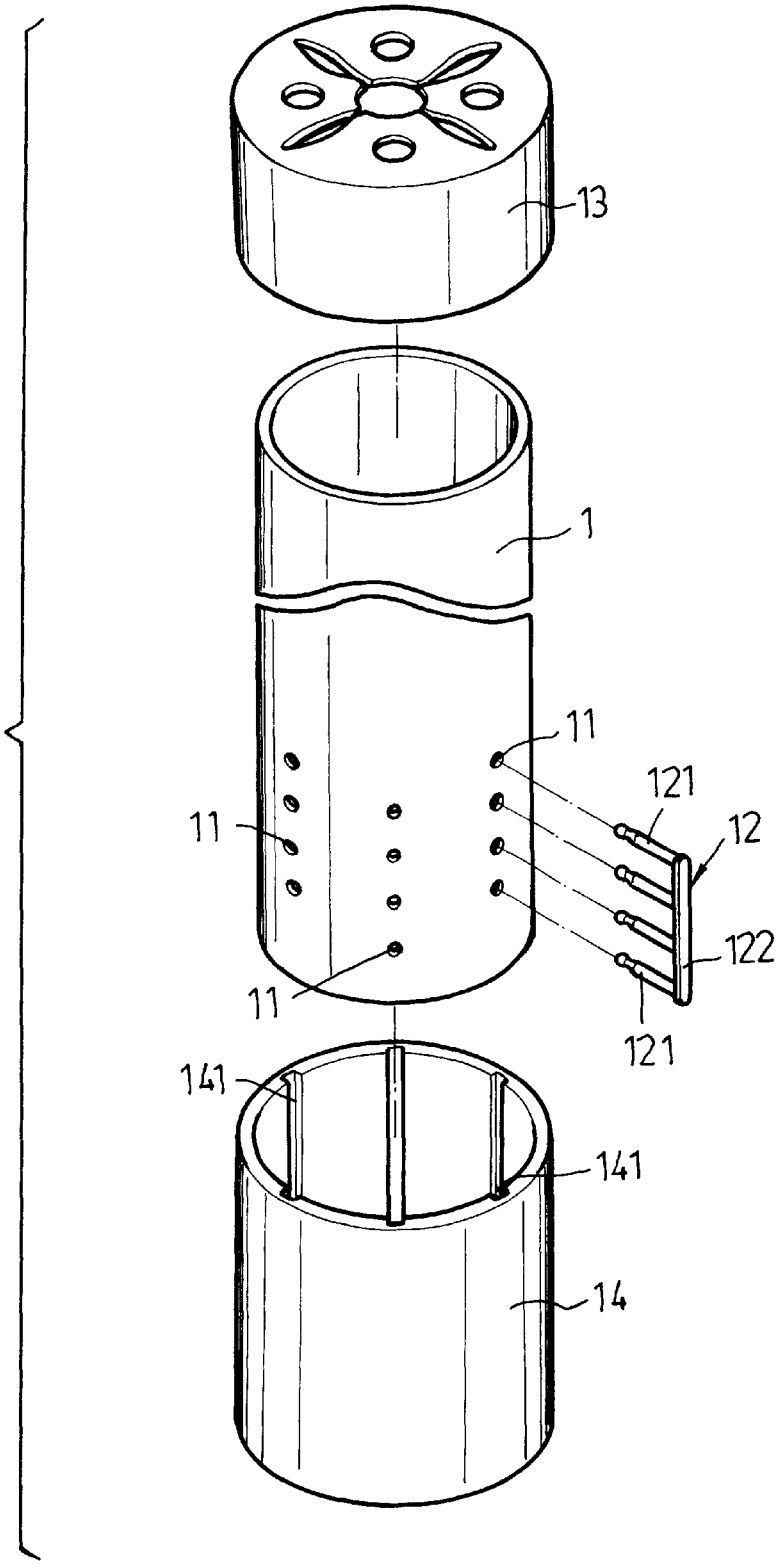
FIG. 2 is an exploded view of the golf club holder for golf bag shown in FIG. 1.
Figure 3:
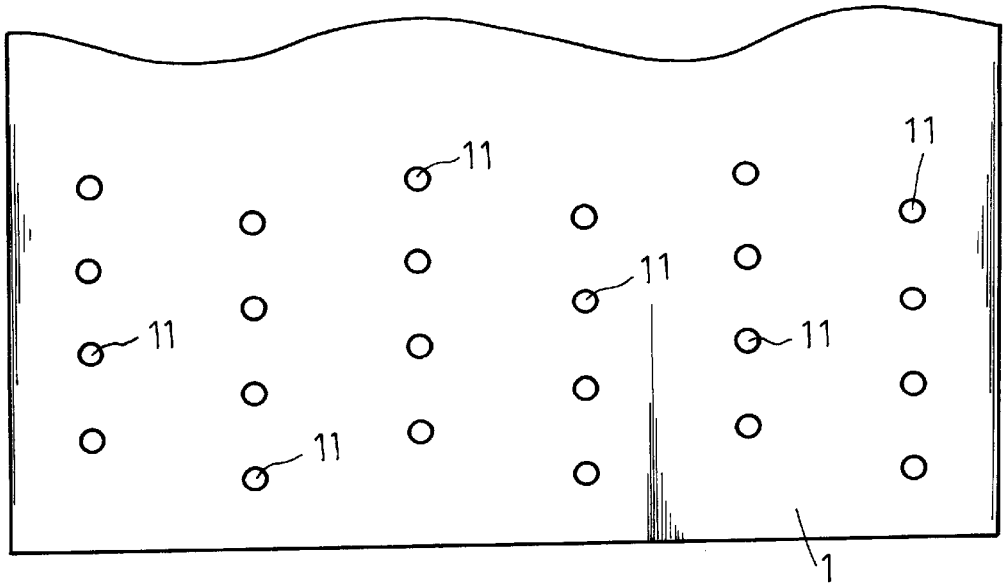
FIG. 3 is an extended out view of the lower end of the tubular body of the individual golf club holder according to the present invention.
Figure 4:
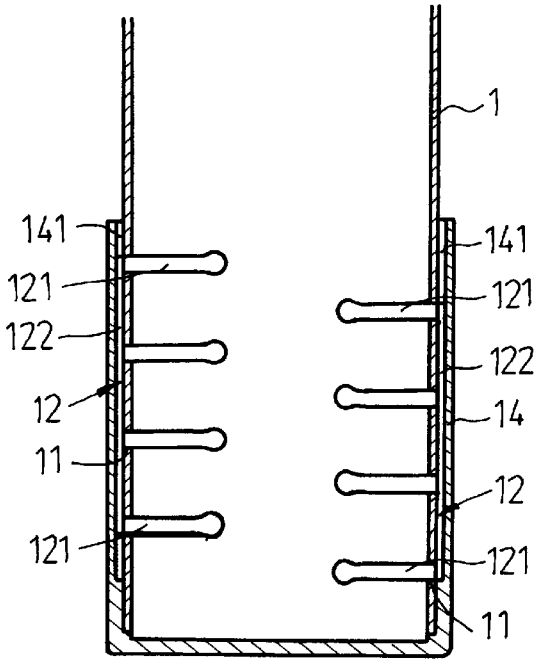
FIG. 4 is a sectional view in an enlarged scale taken along line 4—4 of FIG. 1.
Figure 5:
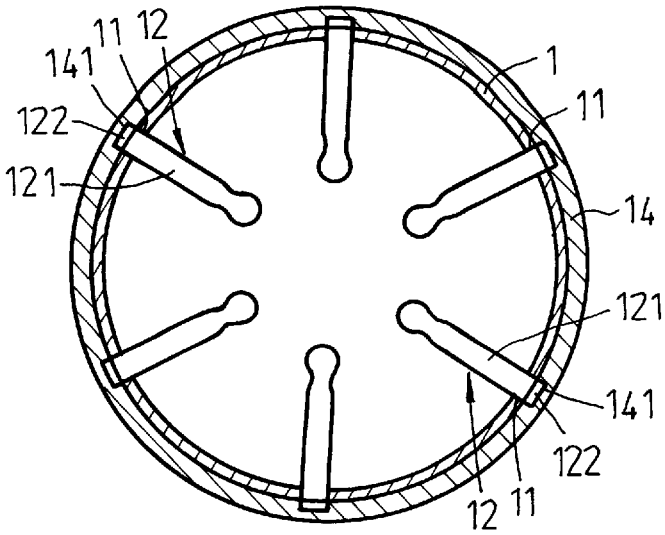
FIG. 5 is a cross sectional view in an enlarged scale of the golf club holder for golf bag shown in FIG. 1.
Figure 6:
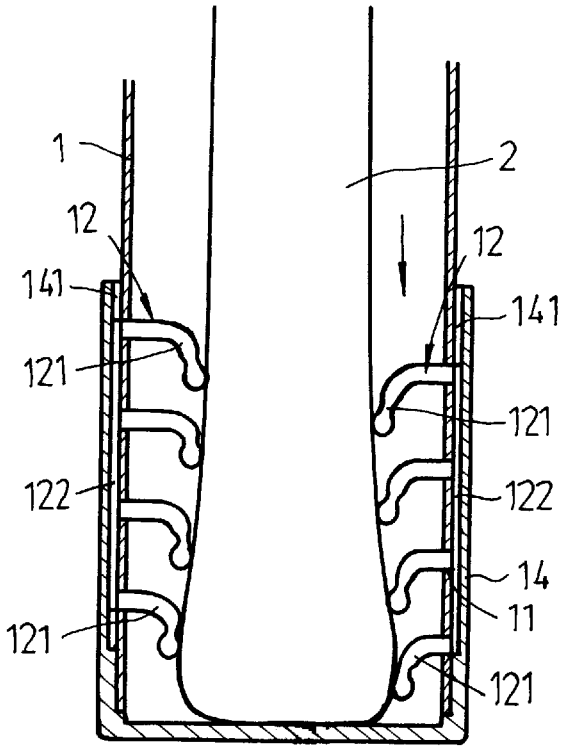
FIG. 6 is a sectional view of the present invention, showing a golf club inserted into the tubular body, the flexible retaining elements deformed and forced into engagement with the periphery of the grip of the inserted golf club.

Referring to FIGS. 5 and 6 and FIGS. 2 and 4 again, the retaining elements 121 of the golf club retainers 12 are flexible retaining rods radially suspended in the tubular body 1. When inserting a golf club 2 into the tubular body 1, the flexible retaining rods 121 are curved downwards and forced into engagement with the periphery of the grip of the inserted golf club 2, and therefore the inserted golf club 2 is firmly held down in the tubular body 1.

Figure 7:
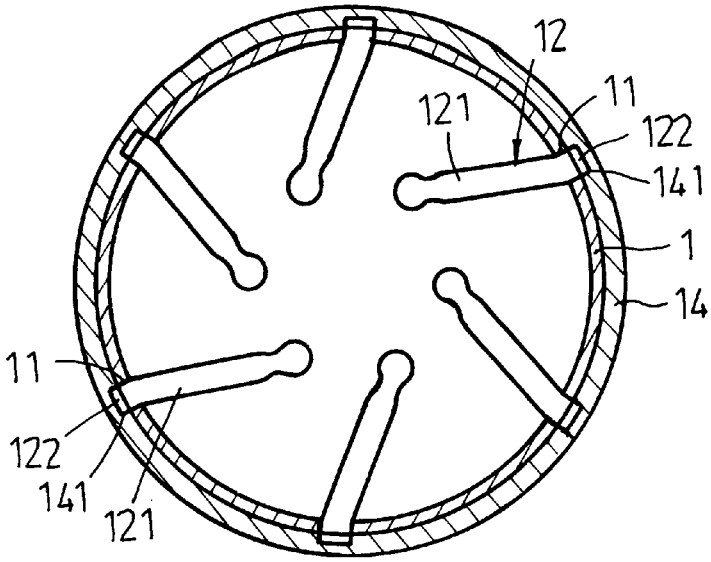
FIG. 7 is a cross sectional view of an individual golf club holder for golf bag according to a second embodiment of the present invention, showing the arrangement of the golf club retainers in the tubular body.
Figure 8:
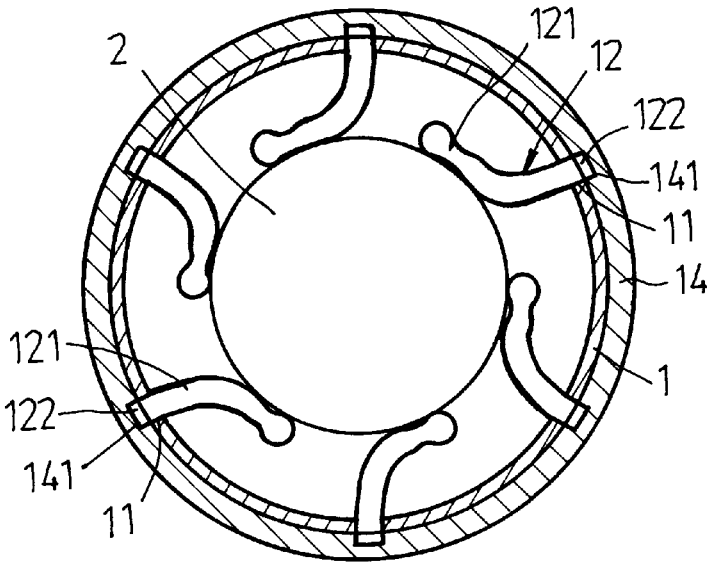
FIG. 8 is a sectional view of the second embodiment of the present invention, showing a golf club inserted into the tubular body, the flexible retaining rods deformed and forced into engagement with the periphery of the grip of the inserted golf club.

Referring to FIGS. 7 and 8, as an alternate form of the present invention, the golf club retainers 12 are spirally arranged in the tubular body 1. When inserting a golf club 2 into the tubular body 1, the flexible retaining rods 121 of the golf club retainers 12 are curved sideways and forced into engagement with the periphery of the grip of the inserted golf club 2, and therefore the inserted golf club 2 is firmly held down in the tubular body 1.

Referring to FIGS. from 2 through 6, the longitudinal rows of through holes 11 are alternatively arranged at different elevations around the periphery of the tubular body 1, so that the flexible retaining rods 121 of the golf club retainers 12 can positively hold down the inserted golf club 2.

Figure 9:
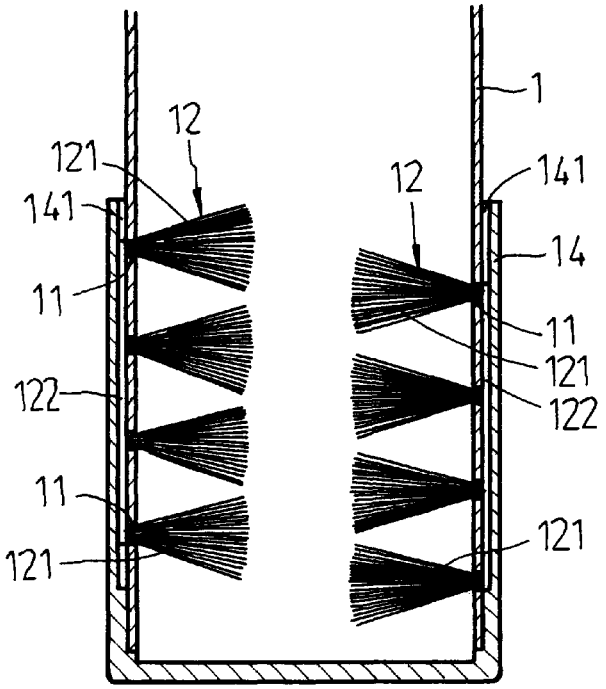
FIG. 9 is a side view in section of an individual golf club holder for golf bag according to a third embodiment of the present invention.
Figure 10:
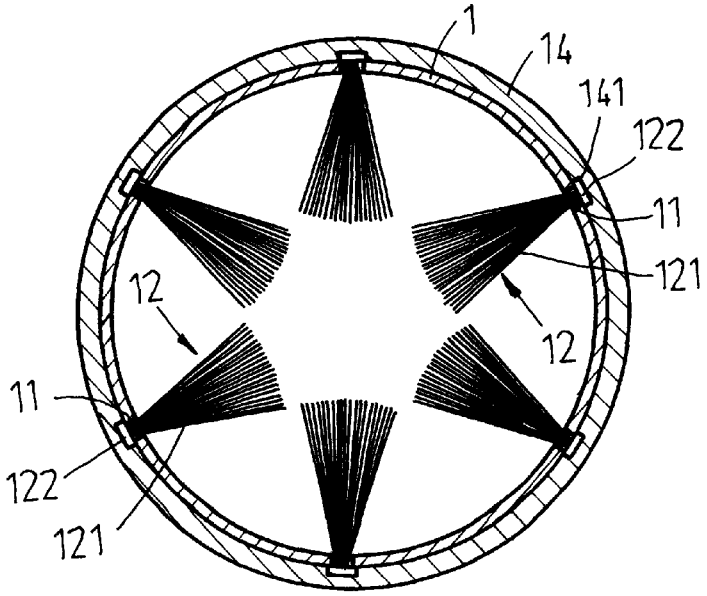
FIG. 10 is a cross sectional view of the individual golf club holder for golf bag according to the third embodiment of the present invention.

Referring to FIGS. 9 and 10, as another alternate form of the present invention, the flexible retaining elements 121 of the golf club retainers 12 are plastic brushes. When inserting a golf club into the tubular body 1, the plastic brushes 121 are deformed and forced into engagement with the periphery of the grip of the inserted golf club.

Referring to FIGS. 1 and 2 and 4 through 10 again, the bottom cap 14 comprises a plurality of longitudinal grooves 141 spaced around the inside wall thereof for the positioning of the connecting rods 122 of the golf club retainers 12.

Figure 11:
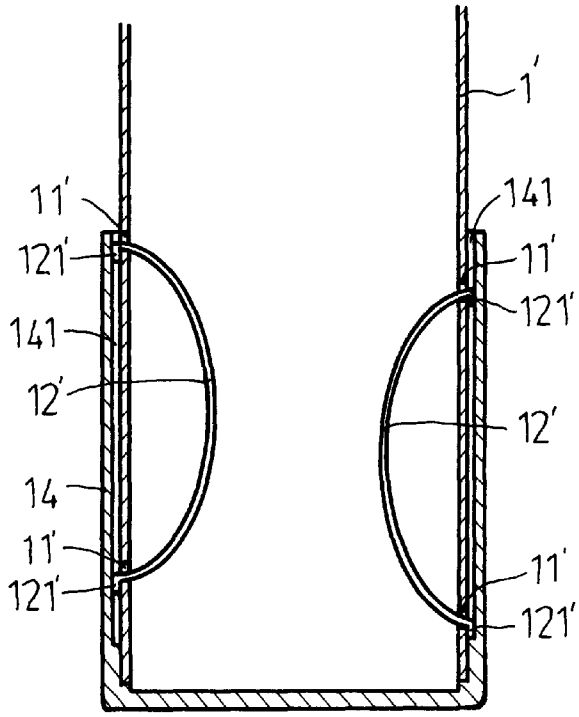
FIG. 11 is a side view in section of an individual golf club holder for golf bag according to a fourth embodiment of the present invention.
Figure 12:
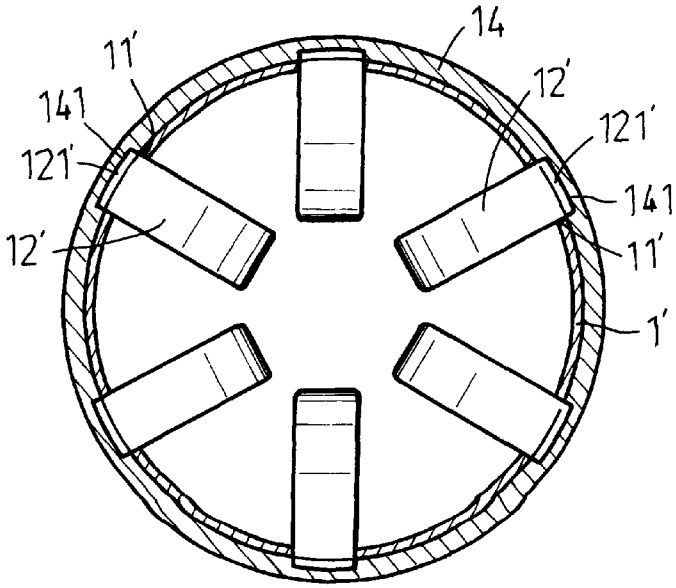
FIG. 12 is a cross sectional view of the individual golf club holder for golf bag according to the fourth embodiment of the present invention.

Referring to FIGS. 11 and 12, as still another alternate form of the present invention, the tubular body 1' comprises pairs of vertically spaced through holes 11', and a plurality of golf club retainers 12' are respectively installed in the through holes 11' for holding down the inserted golf club. The golf club retainers 12' are smoothly arched springy wires suspended in the tubular body 1', each smoothly arched springy wire having two distal ends 121' respectively fastened to one pair of vertically spaced through holes 11'.

What the invention claimed is:

1. An individual golf club holder installed in a golf bag to hold an individual golf club, comprising:

a tubular body having a top end, a bottom end, and multiple sets of vertically spaced through holes spaced around the periphery thereof near said bottom end;

a top cap covered on the top end of said tubular body, said top cap having a circular center hole through which a golf club is inserted into said tubular body;

a plurality of golf club retainers respectively installed in the through holes on said tubular body for engagement with the periphery of the golf club inserted into said tubular body, said golf club retainers each comprising a connecting rod disposed outside said tubular body, and a plurality of retaining elements respectively perpendicularly extended from said connecting rod and respectively inserted through the through holes on said tubular body into the inside of said tubular body; and a bottom cap covered on the bottom end of said tubular body to hold said golf club retainers in place, said bottom cap comprising a plurality of longitudinal grooves spaced around an inside wall thereof for the positioning of the connecting rod of each of said golf club retainers.

2. The individual golf club holder of claim 1 wherein the multiple sets of vertically spaced through holes of said tubular body are alternatively arranged at different elevations around the periphery of said tubular body.

3. The individual golf club holder of claim 1 wherein the retaining elements of said golf club retainers are flexible retaining rods, and said golf club retainers are radially arranged in said tubular body.

4. The individual golf club holder of claim 1 wherein the retaining elements of said golf club retainers are flexible retaining rods, and said golf club retainers are spirally arranged in said tubular body.

5. The individual golf club holder of claim 1 wherein the elements of said golf club retainers are brushes.

6. An individual golf holder installed in a golf bag to hold an individual golf club, comprising:

a tubular body having a top end, a bottom end, and multiple pairs of vertically spaced through holes spaced around the periphery thereof near said bottom end;

a top cap covered on the top end of said tubular body, said top cap having a circular center hole through which a golf club is inserted into said tubular body;

a plurality of smoothly arched springy golf club retaining wires respectively installed in the pairs of through holes on said tubular body and suspended inside said tubular body for engagement with the periphery of the golf club inserted into said tubular body; and a bottom cap covered on the bottom end of said tubular body.

* * * * *